US010444684B2

(12) United States Patent
Kawaguchi

(10) Patent No.: US 10,444,684 B2
(45) Date of Patent: Oct. 15, 2019

(54) FIXING DEVICE AND IMAGE FORMING APPARATUS

(71) Applicant: KYOCERA Document Solutions Inc., Osaka (JP)

(72) Inventor: Kotatsu Kawaguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/247,216

(22) Filed: Jan. 14, 2019

(65) Prior Publication Data

US 2019/0278205 A1 Sep. 12, 2019

(30) Foreign Application Priority Data

Mar. 9, 2018 (JP) ..... 2018-042889

(51) Int. Cl.
*G03G 15/20* (2006.01)

(52) U.S. Cl.
CPC ..... *G03G 15/2053* (2013.01); *G03G 15/2064* (2013.01)

(58) Field of Classification Search
CPC ..... G03G 15/2053; G03G 15/206; G03G 15/2064; G03G 2215/2035
See application file for complete search history.

(56) References Cited

U.S. PATENT DOCUMENTS 7,206,541 B2 4/2007 Fukita et al.
2006/0045589 A1* 3/2006 Iwasaki ..... G03G 15/2042 399/328
2016/0098001 A1* 4/2016 Ogawa ..... G03G 15/2053 399/338
2016/0274511 A1* 9/2016 Ogino ..... G03G 15/2053
2019/0056684 A1* 2/2019 Eiki

FOREIGN PATENT DOCUMENTS

JP 2005-049839 A 2/2005

* cited by examiner

*Primary Examiner* — Sophia S Chen
(74) *Attorney, Agent, or Firm* — Studebaker & Brackett PC

(57) ABSTRACT

A fixing device includes an endless fixing belt, a flat heater, a holder and a pressuring member. The flat heater heats the fixing belt. The holder holds the flat heater so that the flat heater comes into contact with an inner circumference face of the fixing belt, and includes a recessed portion composing a gap between the holder and a face of the flat heater at an opposite side to the fixing belt across the flat heater. The pressuring member sandwiches the fixing belt between the flat heater and the pressuring member, and forms a pressuring area, where a sheet is sandwiched and conveyed at, between the fixing belt and the pressuring member. In a conveying direction of the sheet, a depth of the gap at a first position is larger than a depth of the gap at a second position at a downstream side from the first position.

16 Claims, 11 Drawing Sheets

FIG. 8

| | DEPTH OF GAP (mm) | | ELECTRIC POWER (W) | FIXING BELT SURFACE TEMP. | | | IMAGE GLOSS PEAK VALUE |
|---|---|---|---|---|---|---|---|
| | UPSTREAM END | DOWNSTREAM END | | MINIMUM FIXING TEMP. | HOT-OFFSET TEMP. | FIXABLE TEMP. RANGE | |
| COMPARATIVE EXAMPLE | – | – | 500 | 150 | 190 | 40 | 15 |
| EXAMPLE 1 | 0.5 | 0 | 480 | 144 | 190 | 46 | 23 |
| EXAMPLE 2 | 1 | 0 | 450 | 139 | 190 | 51 | 25 |

FIXING DEVICE AND IMAGE FORMING APPARATUS

INCORPORATION BY REFERENCE

This application is based on and claims the benefit of priority from Japanese Patent application No. 2018-042889 filed on Mar. 9, 2018, the entire contents of which are incorporated herein by reference.

BACKGROUND

The present disclosure relates to a fixing device fixing a toner image on a sheet and an image forming apparatus including this fixing device.

As one manner heating a fixing belt of a fixing device, a manner using a flat heater is known. As an example, the endless fixing belt with flexibility is sandwiched between the flat heater and a pressuring roller and is rotated by friction force at a pressuring area provided between the flat heater and the pressuring roller. The sheet having a transferred toner image is sandwiched between the heated fixing belt and the pressuring roller to be conveyed, and thereby, the toner image is fixed on the sheet.

Conventionally, with respect to such a heating manner using the flat heater, technique achieving excellent energy efficiency and uniformly outputting an image with a high gross level is examined. For example, a conventional fixing device is configured that a pressure between the fixing belt and the pressuring roller is increased from an entrance of a fixing nip (the pressuring area) and, in a sliding face composed of a plate heating body (the flat heater) and a heating body holder, the pressure is maximized at a downstream end of the sliding face in a moving direction of a recording medium.

However, in the above-mentioned conventional fixing device, because friction wear of an inner face of the fixing belt is progressed, it is feared that wear powder is mixed with lubricant to lower slidability. Moreover, because an outer diameter of the pressuring roller is suddenly varied at an exit of the pressuring area, it is feared that crumpling of the sheet and others occur to lower conveyance property.

SUMMARY

In accordance with the present disclosure, a fixing device includes an endless fixing belt, a flat heater, a holder and a pressuring member. The flat heater heats the fixing belt. The holder holds the flat heater so that the flat heater comes into contact with an inner circumference face of the fixing belt, and includes a recessed portion composing a gap between the holder and a face of the flat heater at an opposite side to the fixing belt across the flat heater. The pressuring member sandwiches the fixing belt between the flat heater and the pressuring member, and forms a pressuring area, where a sheet is sandwiched and conveyed at, between the fixing belt and the pressuring member. In a conveying direction of the sheet, a depth of the gap at a first position is larger than a depth of the gap at a second position at a downstream side from the first position.

In accordance with the present disclosure, an image forming apparatus includes an image forming part forming a toner image on the sheet, and the fixing device as described above to fix the toner image on the sheet.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 8 is a table listing fixing belt surface temperature in the fixing device according to the embodiment of the present disclosure.

DETAILED DESCRIPTION

Hereinafter, with reference to the accompanying drawings, embodiments of an image forming apparatus and a fixing device of the present disclosure will be described.

Figure 1:
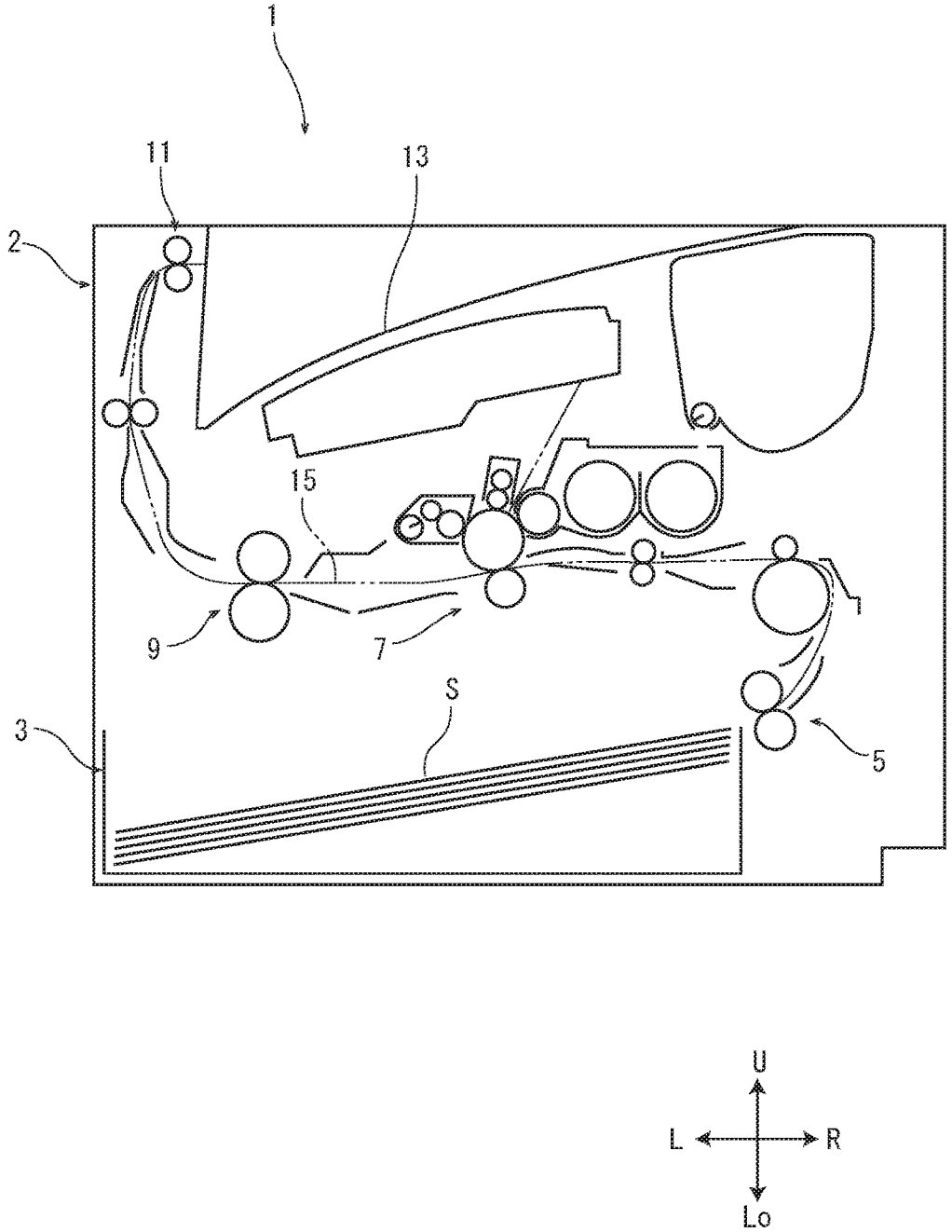
FIG. 1 is a sectional view schematically showing an internal structure of a printer according to an embodiment of the present disclosure.

First, the entire structure of a printer 1 as the image forming apparatus will be described with reference to FIG. 1. FIG. 1 is a sectional view schematically showing an internal structure of the printer 1.

Hereinafter, it will be described so that the front side of the color printer 1 is positioned at a near side on a paper sheet of FIG. 1 and that left and right directions is defined as seen from the front side of the color printer 1. Arrows U, Lo, L, R, Fr and Rr in each of the drawings respectively indicate an upper side, a lower side, a left side, a right side, a front side and a rear side of the printer 1.

In an apparatus body 2 of the printer 1, a sheet feeding cartridge 3 storing sheets S, a sheet feeding device 5 feeding the sheet S from the sheet feeding cartridge 3, an image forming part 7 forming a toner image on the sheet S, a fixing device 9 fixing the toner image on the sheet S, a sheet ejecting device 11 ejecting the sheet S, and an ejected sheet tray 13 receiving the ejected sheet S are provided. Further, in the apparatus body 2, a conveying path 15 of the sheet S is arranged so as to run from the sheet feeding device 5 to the sheet ejecting device 11 through the image forming part 7 and the fixing device 9.

The sheet S fed from the sheet feeding cartridge 3 by the sheet feeding device 5 is conveyed to the image forming part 7 along the conveying path 15 and the toner image is formed on the sheet S. The sheet S is conveyed to the image fixing device 9 along the conveying path 15 and the toner image is fixed on the sheet S. The sheet S having the fixed toner is ejected from the sheet ejecting device 11 to the ejected sheet tray 13.

Figure 2:
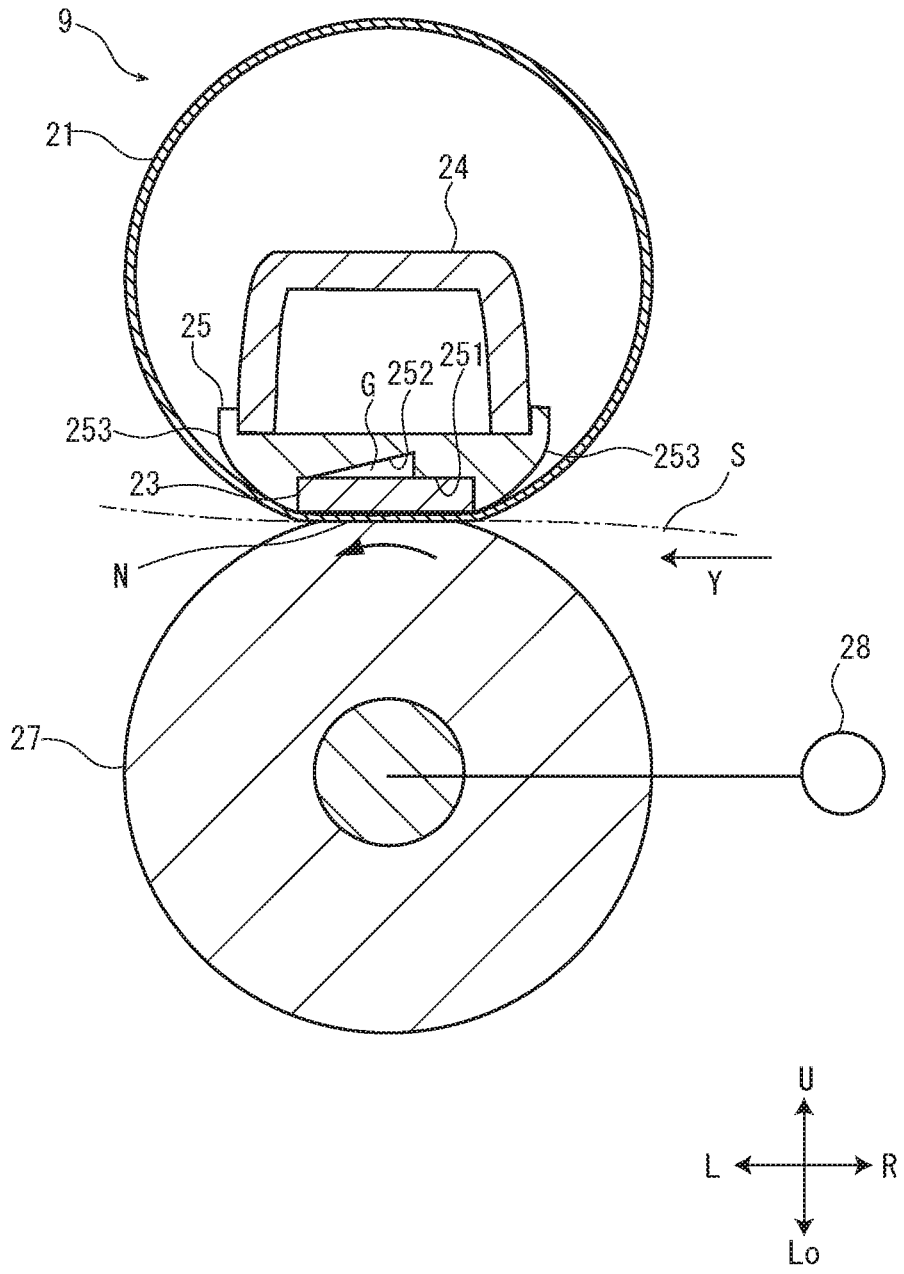
FIG. 2 is a sectional view showing a fixing device according to the embodiment of the present disclosure.
Figure 3:
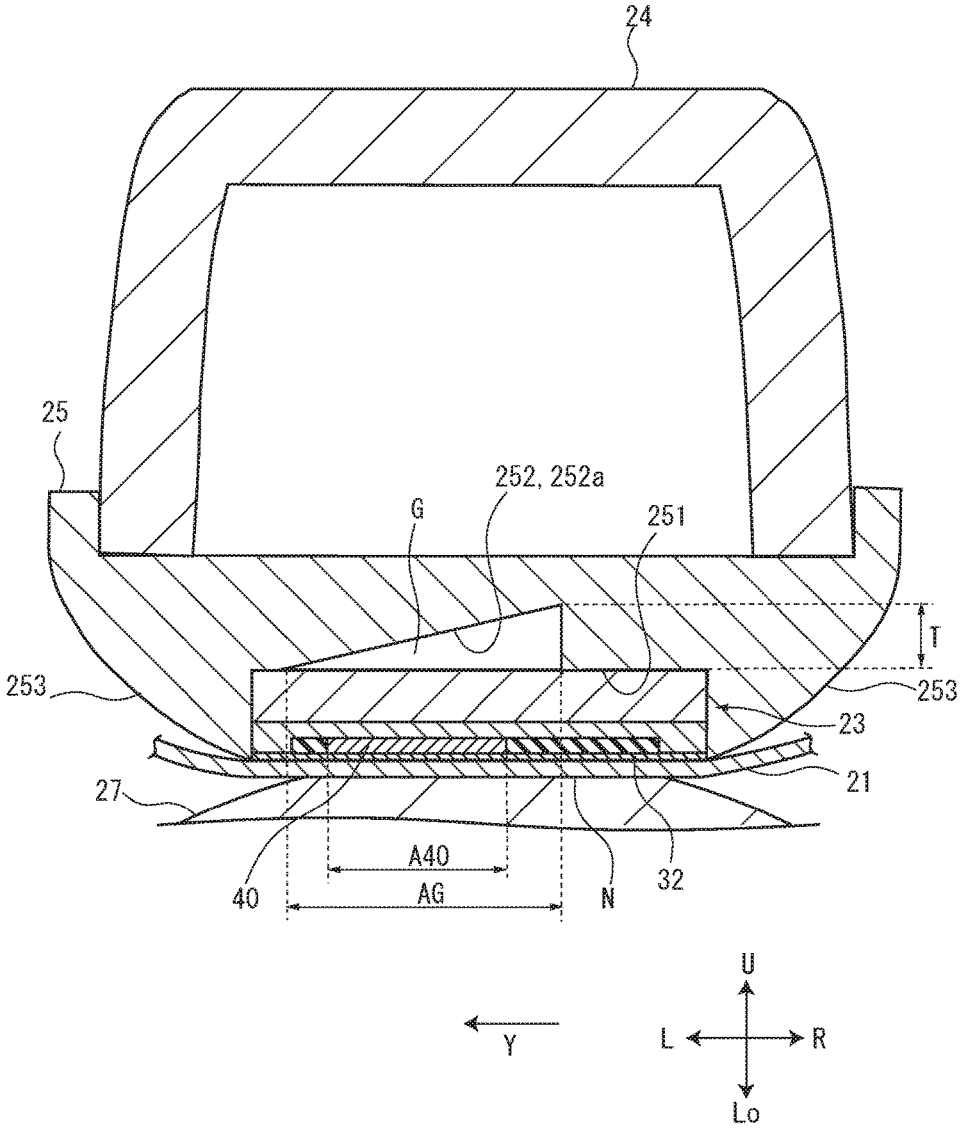
FIG. 3 is a sectional view showing an example of a holder and the periphery of the fixing device according to the embodiment of the present disclosure.

Next, the fixing device 9 will be described with reference to the drawings. FIG. 2 is a sectional view showing the fixing device 9, FIG. 3 is a sectional view showing a holder 25 and the periphery, and FIGS. 4 and 5 are sectional views showing a flat heater 23.

Figure 4:
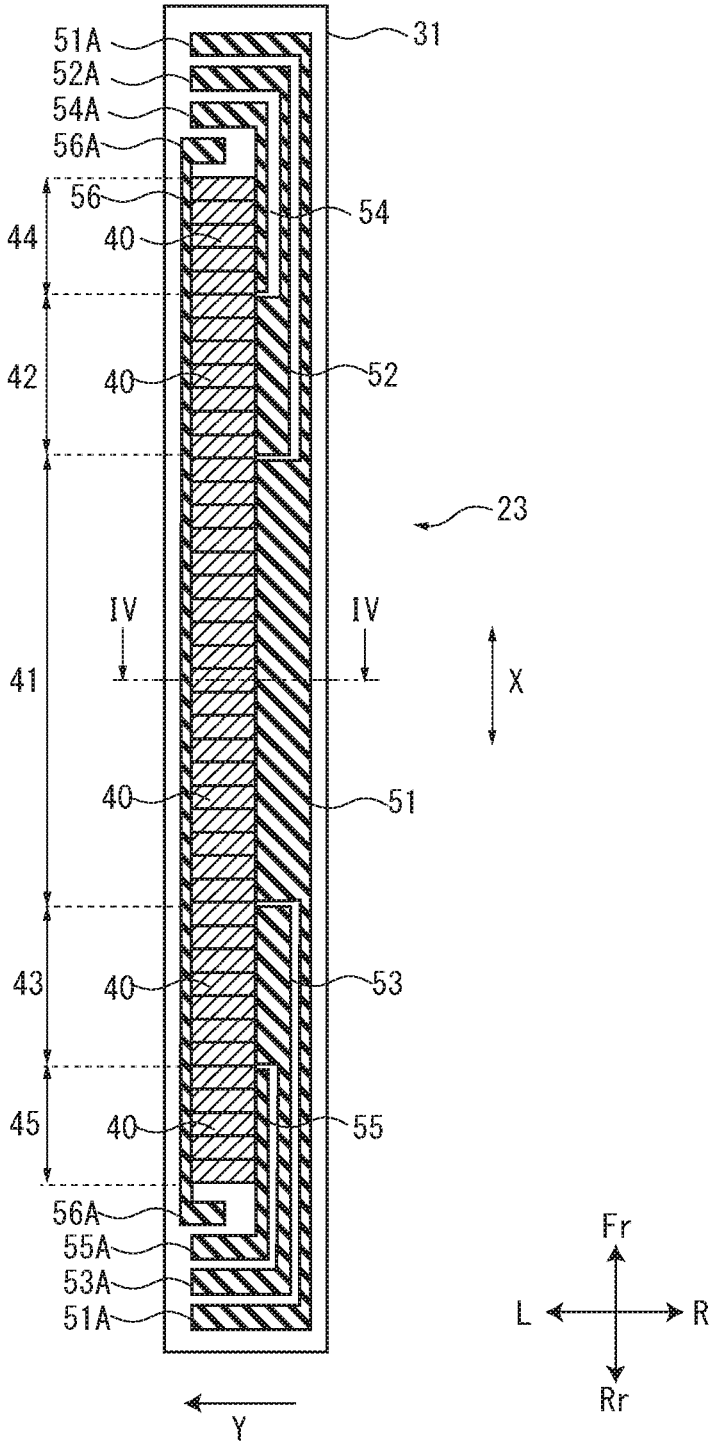
FIG. 4 is a sectional view showing a flat heater, as viewed from an upper side, according to the embodiment of the present disclosure.
Figure 5:
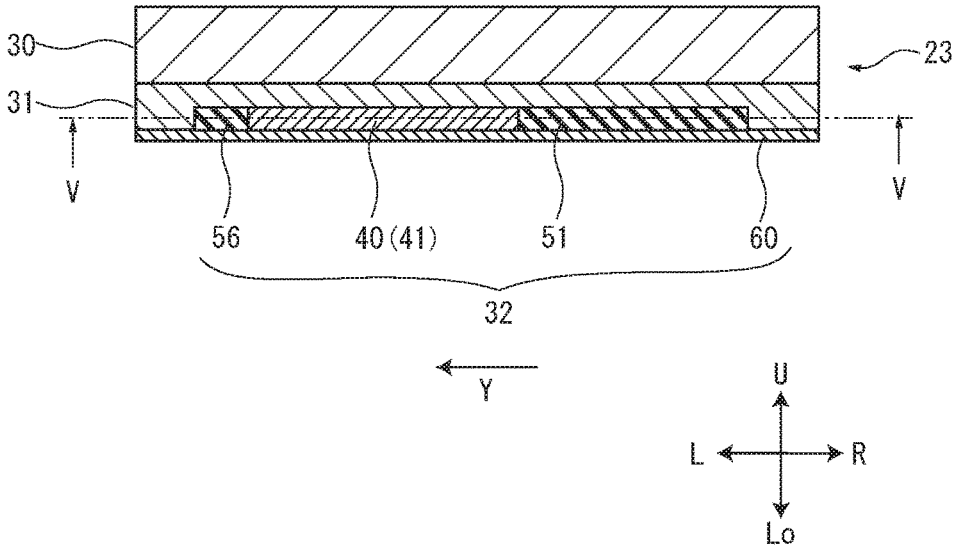
FIG. 5 is a sectional view showing the flat heater, as viewed from a front side, according to the embodiment of the present disclosure.

Incidentally, FIG. 4 is a sectional view along a V-V line in FIG. 5, and FIG. 5 is a sectional view along a IV-IV line in FIG. 4.

As shown in FIG. 2, the fixing device 9 includes a fixing belt 21, the flat heater 23 heating the fixing belt 21, the holder 25 holding the flat heater 23, and a pressuring roller 27 providing a pressuring area N between the fixing belt 21 and the pressuring roller 27. In the following description, an "axial direction X" indicates an axial direction of the pressuring roller 27 (an Fr-Rr direction).

The fixing belt 21 is an endless belt having a predetermined inner diameter and having a width longer than the sheet S, and is formed in a cylindrical shape with a longitudinal direction parallel to the axial direction X. The fixing belt 21 is made of material with flexibility and includes a base material layer, an elastic layer provided around the base material layer, and a release layer provided around the elastic layer. The base material layer is made of metal, such as stainless steel or nickel alloy. The elastic layer is made of silicone rubber or the like. The release layer is made of PFA tube or the like. On the base material layer, a sliding layer may be formed. The sliding layer is made of polyamide-imido, PTFE or the like.

In a hollow portion of the fixing belt 21, a stay 24 penetrates, and both ends of the stay 24 are fixed to a housing (not shown). The stay 24 is a member with a groove shape opened at a side of the pressuring roller 27, and is made of metal, such as stainless steel or aluminum alloy. The fixing belt 21 is supported by an arc shaped belt guide (not shown) supported by the stay 24, and is rotatable along the belt guide.

As shown in FIGS. 4 and 5, the flat heater 23 is formed in a roughly plate shape with a longitudinal direction parallel to the axial direction X. The flat heater 23 includes a base material 30, a heat insulation layer 31, and a heat generation contact part 32, and the respective components are laminated in order of the base material 30, the heat insulation layer 31 and the heat generation contact part 32.

The base material 30 is made of material, such as ceramic, with electrical insulation property, and is formed in a roughly rectangular plate shape with a longitudinal direction parallel to the axial direction X.

As shown in FIG. 5, the heat insulation layer 31 is laminated on one face of the base material 30. The heat insulation layer 31 is made of material, such as ceramic or glass, with electrical insulation property and low heat conductivity, and is formed on the base material 30. The heat insulation layer 31 restrains conducting of heat generated by the heat generation contact part 32 to a side of the base material 30.

The heat generation contact part 32 is laminated on one face of the heat insulation layer 31. The heat generation contact part 32 included a plurality of (e.g. five) heat generating portions 41-45, a plurality of (e.g. six) electrode portions 51-56, and a coat layer 60.

The plurality of heat generating portions 41-45 are made of material, such as metal, with electrical conductivity having a resistance value higher than the plurality of electrode portions 51-56, and is formed on one face of the heat insulation layer 31. As shown in FIG. 4, the plurality of heat generating portions 41-45 are arranged along one line parallel to the axial direction X. Moreover, each of the plurality of heat generating portions 41-45 includes a plurality of resistance heat generating elements 40 (one example of a heat generating element) arranged along one line parallel to the axial direction X.

The heat generating portion 41 is arranged within a range corresponding to a length of a longer side of the sheet S of a small size (e.g. JIS A5 size). The heat generating portions 42 and 43 are arranged within a range corresponding to a length of a longer side of the sheet S of a middle size (e.g. JIS B5 size) where the heat generating portion 41 is not arranged. The heat generating portions 44 and 45 are arranged within a range corresponding to a length of a longer side of the sheet S of a large size (e.g. JIS A4 size) where the heat generating portions 41, 42 and 43 is not arranged.

The plurality of electrode portions 51-56 are made of material, such as metal, with electrical conductivity having a resistance value lower than the resistance heat generating element 40, and is formed on one face of the heat insulation layer 31. The electrode portion 51 is connected to ends of the plurality of resistance heat generating elements 40 included in the heat generating portion 41 at an upstream side in a conveying direction Y of the sheet S. Similarly, the electrode portions 52-55 are connected to ends of the plurality of resistance heat generating elements 40 included in the heat generating portions 42-45, respectively, at the upstream side in the conveying direction Y. On the other hand, the electrode portion 56 is connected to ends of all of the resistance heat generating elements 40 at a downstream side in the conveying direction Y. The respective electrode portions 51-56 are extended to positions outside of the heat generating portions 41-45 in the axial direction X, and in distal ends of the electrode portions 51-56, electrode terminals 51A-56A are respectively provided.

As shown in FIG. 5, the coat layer 60 covers the heat generating portions 41-45 and the electrode portions 51-56. The coat layer 60 is made of material, such as ceramic, with electrical insulation property and small sliding friction force with respect to the fixing belt 21. The coat layer 60 composes a face contacting with an inner face of the fixing belt 21. Incidentally, in portions (at the same level as the heat generating portions 41-45 and the electrode portions 51-56) of the flat heater 23 where the heat generating portions 41-45 and the electrode portions 51-56 are not laminated, material, such as the heat insulation layer 31 or the coat layer 60, with electrical insulation property, is laminated.

The holder 25 is a member having a length equal to a width of the fixing belt 21, and is fixed to the stay 24. The holder 25 is made of, for example, heat resistant resin, such as liquid crystal polymer.

As shown in FIG. 3, in a region of the holder 25 facing to the pressuring roller 27, a first recessed portion 251 extending in the axial direction X is formed. The flat heater 23 is fitted into the first recessed portion 251 so that the heat generation contact part 32 is exposed. The holder 25 holds the flat heater 23 so that the flat heater 23 comes into contact with an inner circumference face of the fixing belt 21. The holder 25 has a curved portion 253 with curvature slightly larger than curvature of the fixing belt 21, and the curved portion 253 and the flat heater 23 compose a smooth face along the inner circumference face of the fixing belt 21.

As shown in FIG. 3, in a bottom of the first recessed portion 251 of the holder 25, a second recessed portion 252 extending in the axial direction X is formed. The second recessed portion 252 is an example of a recessed portion composing a gap G between the holder 25 (the first recessed portion 251) and a face of the flat heater 23 at an opposite side to the fixing belt 21 across the flat heater 23 in a state that the flat heater 23 is fitted into the first recessed portion 251. In the conveying direction Y of the sheet S, a depth (a length of in U-Lo direction in FIG. 3) of the gap G at a first position is larger than a depth of the gap G at a second position at a downstream side from the first position. For example, in an example of FIG. 3, a region (hereinafter, called as a facing region 252*a*) of the second recessed portion 252 facing to the flat heater 23 is formed in a planar shape, and a distance between the facing region 252*a* and the flat heater 23 is set longer as a position of the facing region 252*a* in the conveying direction Y is nearer to the upstream side. Therefore, the gap G is made as a cavity in a wedge-like shape having the depth gradually increasing toward the upstream side in the conveying direction Y.

In the conveying direction Y of the sheet S, the gap G is arranged within a range including a range corresponding to the resistance heat generating elements 40 on the face of the flat heater 23 at the opposite side to the fixing belt 21 across the flat heater 23.

Concretely, as shown in FIG. 3, in the conveying direction Y, a range AG, where the gap G is arranged at, includes a range A40 corresponding to the resistance heat generating elements 40. More concretely, in the conveying direction Y, an upstream side end of the gap G is located at a more upstream side compared with an upstream side end of the range A40 corresponding to the resistance heat generating elements 40, and a downstream side end of the gap G is located at a more downstream side compared with a downstream side end of the range A40 corresponding to the resistance heat generating elements 40.

The pressuring roller 27 includes a core metal, an elastic layer provided around an outer circumference face of the core metal, and a release layer provided around an outer circumference face of the elastic layer. The elastic layer is made of silicon rubber or the like. The release layer is made of PFA tube or the like. The pressuring roller 27 is supported so as to be pressed against the flat heater 23 across the fixing belt 21. That is, the pressuring roller 27 sandwiches the fixing belt 21 between the fixing belt 21 and the pressuring roller 27 to provide the pressuring area N, where the sheet S is sandwiched and conveyed at, between the fixing belt 21 and the pressuring roller 27. The pressuring roller 27 is driven and rotated by a motor 28.

A fixing operation of the fixing device 9 having the above-described configuration will be described. First, the pressuring roller 27 is driven and rotated, and the fixing belt 21 is rotated by following the pressuring roller 27 in an opposite direction to the rotating direction of the pressuring roller 27. Simultaneously, the flat heater 23 is driven to heat the fixing belt 21. The fixing belt 21 is heated to predetermined control temperature (e.g. 160 degrees centigrade). Thus, after the fixing belt 21 is heated, the sheet S having the transferred toner image is conveyed to the pressuring area N. The pressuring area N, the sheet S is sandwiched between the fixing belt 21 and the pressuring roller 27, and conveyed to in the predetermined conveying direction Y. In this time, the sheet S is heated by the fixing belt 21, and pressured by the fixing belt 21 and the pressuring roller 27, and thereby, the toner image is fixed on the sheet S. The sheet S having the fixed toner image is separated from the fixing belt 21, and conveyed along the conveying path 15.

Next, a result of the embodiment will be described by using experimentation results. When the image forming apparatus, in which the fixing device 9 having the above-described configuration is installed, was used to execute the fixing operation under the following-described conditions, heater surface temperature and toner temperature were measured.

Length of the flat heater 23 in the conveying direction Y: 13 mm, length of the resistance heat generating element 40 in the conveying direction Y: 6 mm, length of the pressuring area N in the conveying direction Y: 10 mm, thickness of the flat heater 23: 1 mm, length of the gap G in the conveying direction Y: 6 mm, depth of the gap G (depth T at the upstream side end in FIG. 3): 1 mm, load in the pressuring area N required for the fixing operation: 120 MPa, linear speed: 250 mm/sec, pressuring time: 40 msec.

Figure 6:
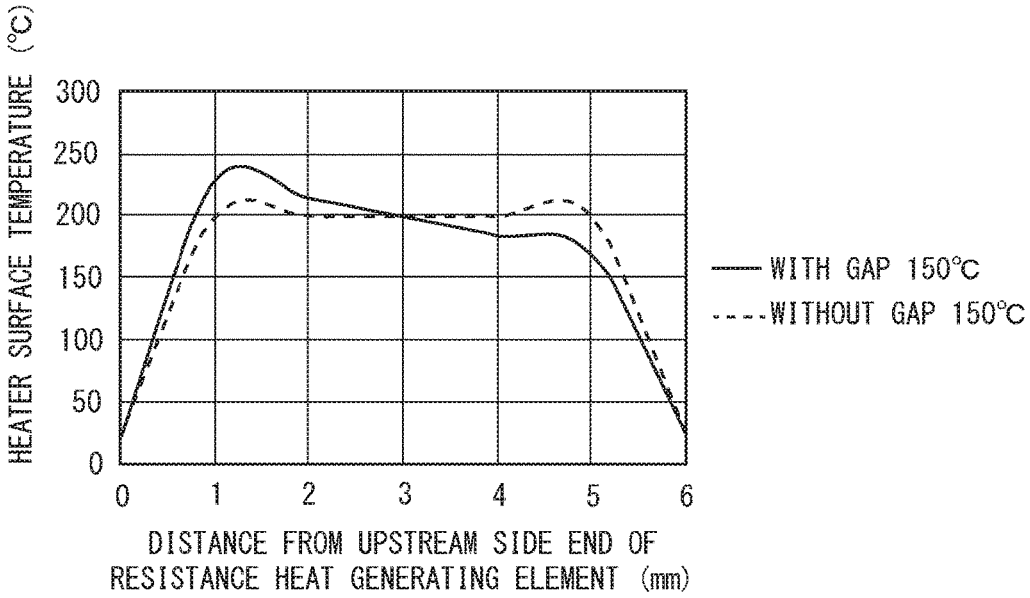
FIG. 6 is a graph plotting heater surface temperature in the fixing device according to the embodiment of the present disclosure.

FIG. 6 is a graph plotting the heater surface temperature. A horizontal axis on the graph indicates a distance from the upstream side end on the resistance heat generating elements 40 (the upstream side end on the resistance heat generating elements 40 in the conveying direction Y), and a vertical axis indicates the heater surface temperature. The heater surface temperature in a case where the above-described gap G is provided is indicated by a solid line, and the heater surface temperature in a case where the above-described gap G is not provided is indicated by a broken line. Both fixing belt surface temperatures in these two examples are controlled by 150 degrees centigrade. It is shown that the heater surface temperature at the upstream side in the case where the gap G is provided becomes higher than the case where the gap G is not provided. This means a heat insulation effect of the gap G, i.e. a result of restraining heat conductivity from the resistance heat generating elements 40 to the holder 25 by the gap G. Moreover, it is shown that since the depth of the gap G is set larger toward the upstream side, the heat insulation effect becomes larger toward the upstream side.

Figure 7:
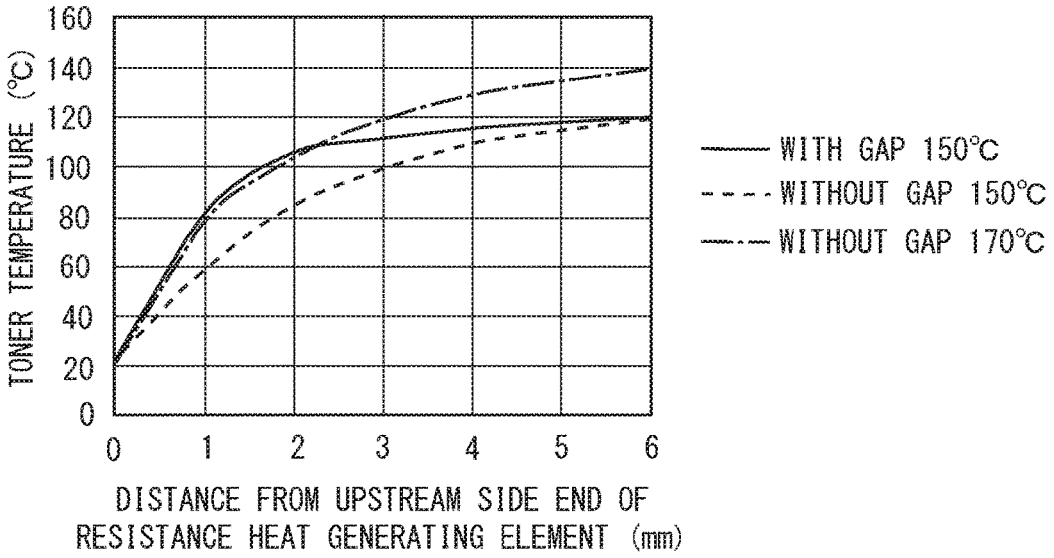
FIG. 7 is a graph plotting toner temperature in the fixing device according to the embodiment of the present disclosure.

FIG. 7 is a graph plotting the toner temperature. A horizontal axis on the graph indicates a distance from the upstream side end on the resistance heat generating elements 40 (the upstream side end on the resistance heat generating elements 40 in the conveying direction Y), and a vertical axis indicates the toner temperature. The toner temperature in a case where the above-described gap G is provided is indicated by a solid line, and the toner temperature in a case where the above-described gap G is not provided is indicated by a broken line. Both fixing belt surface temperatures in these two examples are controlled by 150 degrees centigrade. It is shown that the toner temperature in the pressuring area N at the upstream side in the case where the gap G is provided becomes higher than the case where the gap G is not provided. This means that since the heat insulation effect of the gap G becomes larger toward the upstream side, toner heating efficiency is improved at the upstream side. Moreover, at the downstream side, since a difference between the toner temperatures in these two examples becomes smaller toward a downstream side end of the resistance heat generating elements 40, hot-offset resistances are equal to each other.

In addition, in FIG. 7, the toner temperature in a case where the gap G is not provided and the fixing belt surface temperature is controlled by 170 degrees centigrade is indicated by a dot chain line. It is shown that, in the case where the gap G is provided, even if the fixing belt surface temperature is 150 degrees centigrade, the toner temperature at the upstream side becomes equal to the case where the gap G is not provided and the fixing belt surface temperature is 170 degrees centigrade. This means that, by the heat insulation effect of the gap G, even if the fixing belt surface temperature is 150 degrees centigrade, at the upstream side, it is possible to achieve heating efficiency equal to the case the fixing belt surface temperature is 170 degrees centigrade.

FIG. 8 is a table of experimentation results indicating relationship of the fixing belt surface temperature and others with respect to the depth of the gap G. In the table, an example 2 is an experimentation result in a case where the above-described gap G (with the depth of 1 mm at the upstream side end) is provided, and an example 1 is an experimentation result in a case where the depth of the gap G at the upstream side end is changed to 0.5 mm. A comparative example is an experimentation result in a case where the gap G is not provided.

Electric power shown in FIG. 8 is electric power consumption of the resistance heat generating element 40. Minimum fixing temperature is a minimum value of surface temperature of the fixing belt 21 in a state being able to fix the toner. That is, an experimentation result shown in FIG. 8 shows a result of examining fixing conditions of the toner according to a plurality of electric power values and of specifying a minimum value of the electric power, by which excellent fixing is achieved, and the fixing belt surface temperature (minimum fixing temperature) corresponding to this minimum value.

Hot-offset temperature is minimum temperature at which hot-offset occurs (the hot-offset is a phenomenon in which a toner layer is divided and a part of the toner is shifted to the fixing belt 21, in a case where temperature of the fixing belt 21 becomes too high and cohesive force of the toner becomes less than adhesive force between the fixing belt 21 and the sheet S). A range of fixable temperature is a difference between the hot-offset temperature and the minimum fixing temperature. An image gloss peak value is a measured value obtained by measuring glossiness of the image formed by fixing the toner in a predetermined manner.

Comparing the comparative example and the example 1, the minimum fixing temperature of the example 1 is lower than the comparative example. It is considered that this is caused because toner melting is progressed at the upstream side in comparison with the comparative example, even if the fixing belt surface temperature is lowered, since the heat insulation effect of the gap G is larger toward the upstream side. That is, it is deemed that energy efficiency and low temperature fixing property of the example 1 is more excellent than the comparative example, and fixable temperature area of the example 1 is broader than the comparative example. Moreover, the image gloss peak value of the example 1 is improved more than the comparative example, and the example 1 can obtain a glossier image than the comparative example. This means that since the toner melting is progressed at the upstream side, smoothness of the toner image by pressuring in the pressuring area N is improved.

Comparing the example 1 and the example 2, the minimum fixing temperature of the example 2 is lower than the example 1, and the image gloss peak value of the example 2 is improved more than the example 1. This means that since the depth of the gap G of the example 2 is increased more than the example 1, the toner melting is further progressed.

As described above, in accordance with the disclosure, it is possible to provide the fixing device 9 achieving high glossy image in a manner heating the fixing belt 21 by using the flat heater 23 while making energy efficiency, low temperature fixing property and hot-offset resistance excellent and broadening the fixable temperature area, and to provide the image forming apparatus including this fixing device 13.

In addition, in the embodiment, since the gap G is provided within the range in the conveying direction Y including the range corresponding to the resistance heat generating elements 40 on the face of the flat heater 23 at the opposite side to the fixing belt 21 across the flat heater 23, it is possible to restrain heat conductivity from the resistance heat generating elements 40 to the holder 25 in comparison with a case where the gap G is provided narrower than the range corresponding to the resistance heat generating elements 40.

Moreover, in the conveying direction Y, since the upstream side end of the gap G is located at the more upstream side compared with the upstream side end of the range A40 corresponding to the resistance heat generating elements 40, it is possible to restrain heat conductivity from the upstream side end of the resistance heat generating elements 40 to the holder 25 in comparison with a case where the upstream side end of the gap G is equal to the upstream side end of the range A40 corresponding to the resistance heat generating elements 40.

Furthermore, in the conveying direction Y, since the downstream side end of the gap G is located at the more downstream side compared with the downstream side end of the range A40 corresponding to the resistance heat generating elements 40, it is possible to restrain heat conductivity from the downstream side end of the resistance heat generating elements 40 to the holder 25 in comparison with a case where the downstream side end of the gap G is equal to the downstream side end of the range A40 corresponding to the resistance heat generating elements 40.

FIG. 3 illustrates an example of the gap G made in a wedge-like shape having the depth gradually increasing toward the upstream side in the conveying direction Y, but the gap G is not restricted by this example. The gap G may be made in a different shape from the example in FIG. 3 as long as the gap G satisfies a condition that, in the conveying direction of the sheet S, the depth of the gap G at the first position is larger than the depth of the gap G at the second position at the downstream side from the first position.

Figure 9:
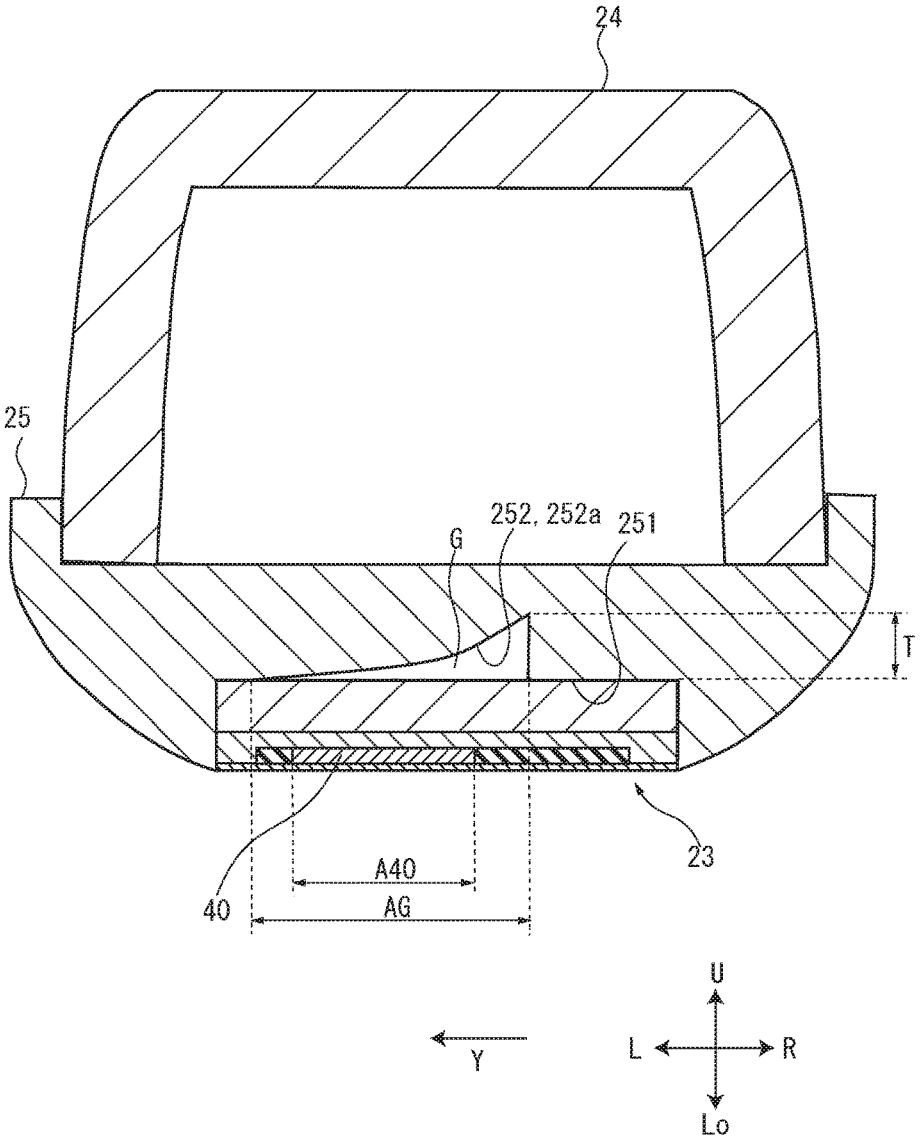
FIG. 9 is a sectional view showing another example of the holder and the periphery of the fixing device according to the embodiment of the present disclosure.
Figure 10:
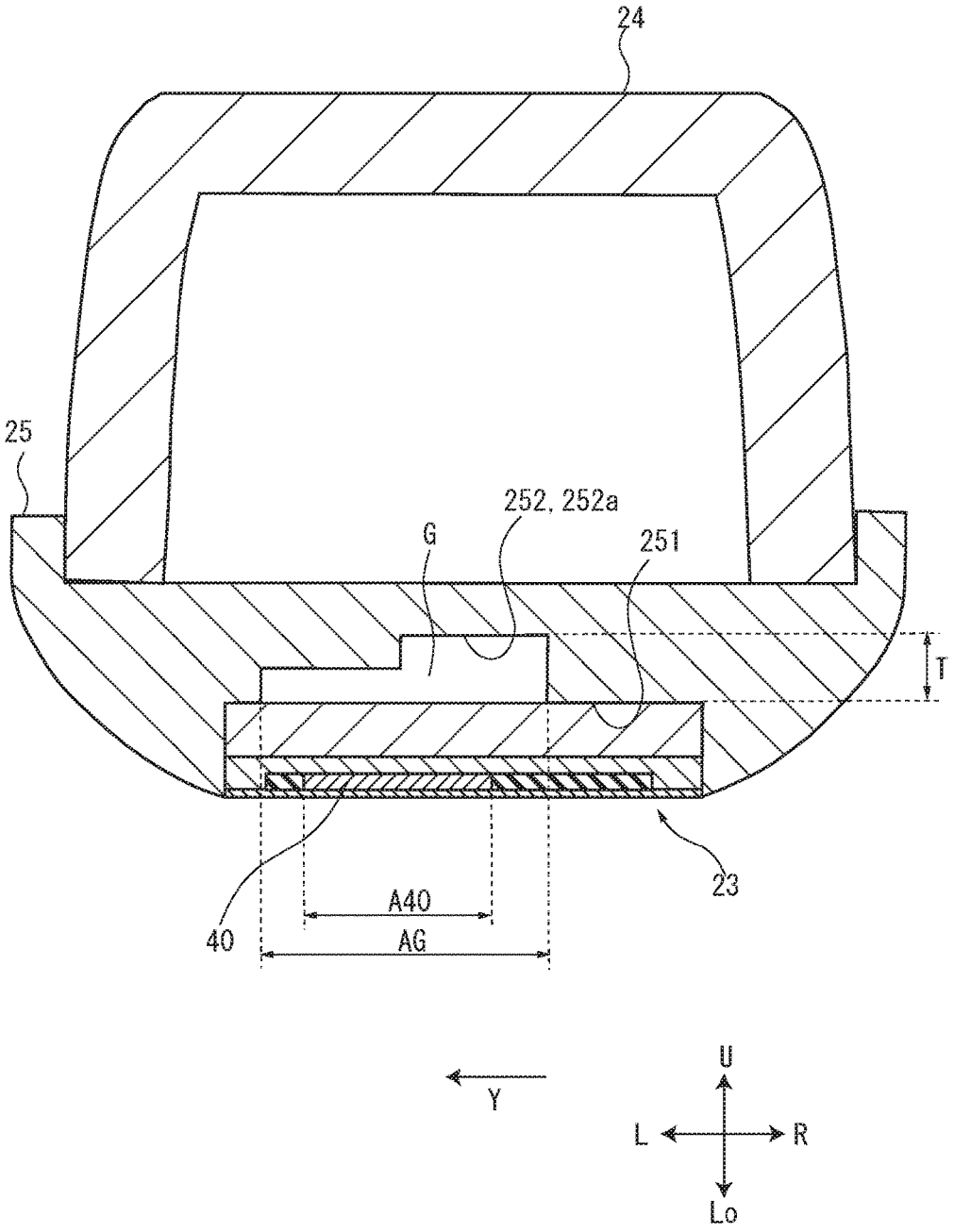
FIG. 10 is a sectional view showing a further example of the holder and the periphery of the fixing device according to the embodiment of the present disclosure.
Figure 11:
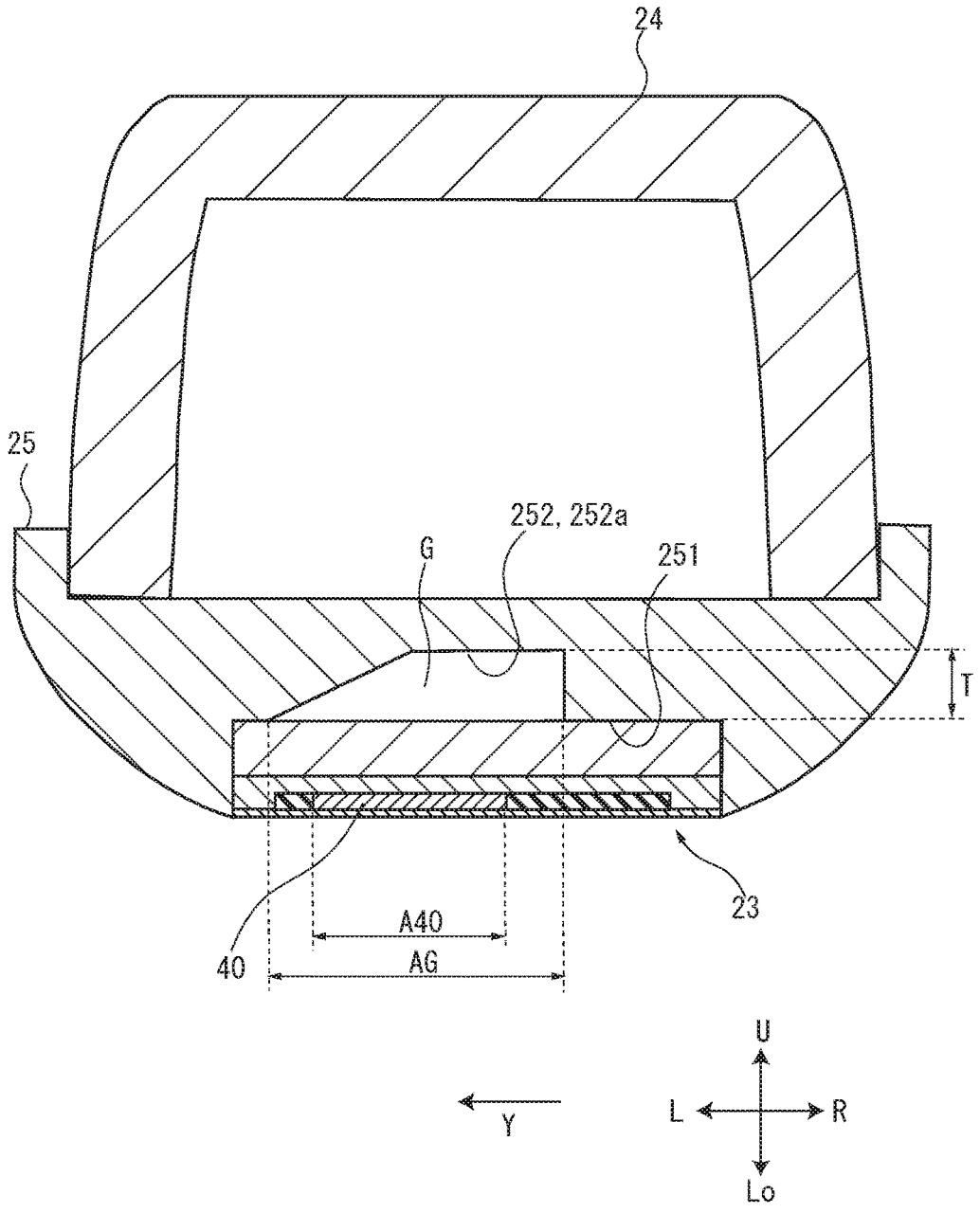
FIG. 11 is a sectional view showing a furthermore example of the holder and the periphery of the fixing device according to the embodiment of the present disclosure.

For example, an example shown in FIG. 9 is an example of forming the facing region 252*a* of the second recessed portion 252 in a protruded curved face shape. Alternatively, the facing region 252*a* may be formed in a recessed curved face shape. An example shown in FIG. 10 is an example of forming the facing region 252*a* in a step-wise shape. An example shown in FIG. 11 is an example of forming the facing region 252*a* so that a distance between the facing region 252*a* and the flat heater 23 is constant in a section at a more upstream side from a middle position (an intermediate point between the upstream side end and the downstream side end) between the upstream side end (an end of the facing region 252*a* at the upstream side in the conveying direction Y) and the downstream side end (an end of the facing region 252*a* at the downstream side in the conveying direction Y) of the facing region 252*a*, and the distance between the facing region 252*a* and the flat heater 23 becomes shorter from the upstream side toward the downstream side in a section at a more downstream side from the middle position between the upstream side end and the downstream side end of the facing region 252*a*. Alternatively, the facing region 252*a* may be formed so that the distance between the facing region 252*a* and the flat heater 23 is constant in the section at the more downstream side from the middle position between the upstream side end and the downstream side end of the facing region 252*a*, and the distance between the facing region 252*a* and the flat heater 23 becomes shorter from the upstream side toward the downstream side in the section at the more upstream side from the middle position between the upstream side end and the downstream side end of the facing region 252*a*. Configurations shown in FIGS. 9-11 also can achieve the same effect as the above-described embodiment.

In the above-described embodiment, an example of the gap G is illustrated so that, in the conveying direction Y, the upstream side end of the gap G is located at the more upstream side compared with the upstream side end of the range A40 corresponding to the resistance heat generating elements 40, and the downstream side end of the gap G is located at the more downstream side compared with the downstream side end of the range A40 corresponding to the resistance heat generating elements 40, but the gap G is not restricted by this example. For example, the upstream side end of the gap G may be located at the more upstream side compared with the upstream side end of the range A40 corresponding to the resistance heat generating elements 40, and the downstream side end of the gap G may be equal to the downstream side end of the range A40 corresponding to the resistance heat generating elements 40. Alternatively, the upstream side end of the gap G may be equal to the upstream side end of the range A40 corresponding to the resistance heat generating elements 40, and the downstream side end of the gap G may be located at the more downstream side compared with the downstream side end of the range A40 corresponding to the resistance heat generating elements 40. Further alternatively, the upstream side end of the gap G may be equal to the upstream side end of the range A40 corresponding to the resistance heat generating elements 40, and the downstream side end of the gap G may be equal to the downstream side end of the range A40 corresponding to the resistance heat generating elements 40.

Although, in the present embodiment, a case where the present disclosure is applied to the monochrome printer 1 has been described as one example, the disclosure is not restricted by this, but may be applied to a color printer, a copying machine, a facsimile, a multifunction peripheral or the like.

The above-description of the embodiment of the present disclosure was described about a preferable embodiment of the fixing device 13 and the image forming apparatus according to the disclosure. Therefore, although there were cases where technically preferable various definitions were applied, the technical scope of the present disclosure is not limited to the embodiments, unless limitation of the disclosure is specified. Components in the embodiment described above can be appropriately exchanged with existing components, and various variations including combinations with other existing components are possible. The description of the embodiment described above does not limit the content of the disclosure described in the claims.

The invention claimed is:

1. A fixing device comprising:

an endless fixing belt;

a flat heater heating the fixing belt;

a holder holding the flat heater so that the flat heater comes into contact with an inner circumference face of the fixing belt, and including a recessed portion composing a gap between the holder and a face of the flat heater at an opposite side to the fixing belt across the flat heater; and a pressuring member sandwiching the fixing belt between the flat heater and the pressuring member, and forming a pressuring area, where a sheet is sandwiched and conveyed at, between the fixing belt and the pressuring member;

wherein, in a conveying direction of the sheet, a depth of the gap at a first position is larger than a depth of the gap at a second position at a downstream side from the first position.

2. The fixing device according to claim 1, wherein the flat heater includes a heat generating element, the gap is provided within a range in the conveying direction including a range corresponding to the heat generating element on a face of the flat heater at an opposite side to the fixing belt across the flat heater.

3. The fixing device according to claim 2, wherein an upstream side end of the gap in the conveying direction is located at a more upstream side compared with an upstream side end of the range corresponding to the heat generating elements.

4. The fixing device according to claim 3, wherein a downstream side end of the gap in the conveying direction is located at a more downstream side compared with a downstream side end of the range corresponding to the heat generating elements.

5. An image forming apparatus comprising:

an image forming part forming a toner image on the sheet; and the fixing device according to claim 4 to fix the toner image on the sheet.

6. An image forming apparatus comprising:

an image forming part forming a toner image on the sheet; and the fixing device according to claim 3 to fix the toner image on the sheet.

7. An image forming apparatus comprising:

an image forming part forming a toner image on the sheet; and the fixing device according to claim 2 to fix the toner image on the sheet.

8. The fixing device according to claim 1, wherein in the recessed portion, a facing region facing to the flat heater is formed in a planar shape, and the gap is made in a wedge-like shape having the depth gradually increasing toward an upstream side in the conveying direction.

9. An image forming apparatus comprising:

an image forming part forming a toner image on the sheet; and the fixing device according to claim 8 to fix the toner image on the sheet.

10. The fixing device according to claim 1, wherein in the recessed portion, a facing region facing to the flat heater is formed in a protruded curved face shape.

11. An image forming apparatus comprising:

an image forming part forming a toner image on the sheet; and the fixing device according to claim 10 to fix the toner image on the sheet.

12. The fixing device according to claim 1, wherein in the recessed portion, a facing region facing to the flat heater is formed in a step-wise shape.

13. An image forming apparatus comprising:

an image forming part forming a toner image on the sheet; and the fixing device according to claim 12 to fix the toner image on the sheet.

14. The fixing device according to claim 1, wherein in the recessed portion, a facing region facing to the flat heater is formed so that a distance between the facing region and the flat heater is constant in a section at an upstream side in the conveying direction, and the distance between the facing region and the flat heater becomes shorter from the upstream side toward the downstream side in a section at the downstream side in the conveying direction.

15. An image forming apparatus comprising:

an image forming part forming a toner image on the sheet; and the fixing device according to claim 14 to fix the toner image on the sheet.

16. An image forming apparatus comprising:

an image forming part forming a toner image on the sheet; and the fixing device according to claim 1 to fix the toner image on the sheet.

* * * * *